US009682847B2

(12) United States Patent
Matheisl et al.

(10) Patent No.: US 9,682,847 B2
(45) Date of Patent: Jun. 20, 2017

(54) FASTENING DEVICE FOR FASTENING A STEP OR A PALLET TO A TRACTION MECHANISM

(71) Applicant: Inventio AG, Hergiswil (CH)

(72) Inventors: Michael Matheisl, Vösendorf (AT); Thomas Illedits, Neufeld (AT); Werner Eidler, Göllersdorf (AT); Robert Schulz, Vienna (AT); Wolfgang Neszmerak, Vienna (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 15/030,908

(22) PCT Filed: Sep. 18, 2014

(86) PCT No.: PCT/EP2014/069857
§ 371 (c)(1),
(2) Date: Apr. 21, 2016

(87) PCT Pub. No.: WO2015/058909
PCT Pub. Date: Apr. 30, 2015

(65) Prior Publication Data

US 2016/0257532 A1 Sep. 8, 2016

(30) Foreign Application Priority Data

Oct. 23, 2013 (EP) ..... 13189806

(51) Int. Cl.
*B66B 23/12* (2006.01)
*B66B 23/10* (2006.01)
(Continued)

(52) U.S. Cl.
CPC ..... *B66B 23/12* (2013.01); *B66B 21/02* (2013.01); *B66B 21/10* (2013.01); *B66B 23/10* (2013.01); *B66B 19/007* (2013.01)

(58) Field of Classification Search
CPC ..... B66B 23/12; B66B 23/10
See application file for complete search history.

(56) References Cited

U.S. PATENT DOCUMENTS 4,244,457 A 1/1981 Ernst
5,072,821 A * 12/1991 Kruse ..... B66B 23/02 198/327
(Continued)

FOREIGN PATENT DOCUMENTS

CN 1308012 A 8/2001
CN 2716225 Y 8/2005
(Continued)

*Primary Examiner* — Thomas Randazzo
(74) *Attorney, Agent, or Firm* — Ladas & Parry LLP

(57) ABSTRACT

A fastening device for connecting a step of an escalator or a pallet of a moving walkway with at least one traction means. The fastening device includes a shoulder element, a wedge type connector and a projection. The shoulder and projection are each oppositely located on the step/pallet and traction means to be joined. The shoulder is provided with an opening through which, in the mounted state of the fastening device, the projection extends. The wedge type connector is positioned at least partially between the shoulder and the projection to engage the with the projection to fix the step or pallet against the traction means in a pre-tensioned manner.

17 Claims, 3 Drawing Sheets

(51) Int. Cl.

| | |
|---|---|
| ***B66B 21/02*** | (2006.01) |
| ***B66B 21/10*** | (2006.01) |
| *B66B 19/00* | (2006.01) |

(56) References Cited

U.S. PATENT DOCUMENTS

| | | | | | |
|---|---|---|---|---|---|
| 5,918,722 | A * | 7/1999 | Behle | B66B 23/12 | 198/333 |
| 7,140,484 | B2 * | 11/2006 | Stuffel | B66B 23/12 | 198/326 |
| 7,410,043 | B2 * | 8/2008 | Aulanko | B66B 23/10 | 198/333 |
| 2004/0060800 | A1 * | 4/2004 | Hauer | B66B 23/12 | 198/333 |

FOREIGN PATENT DOCUMENTS

| | | | | |
|---|---|---|---|---|
| CN | 1942389 | A | 4/2007 | |
| DE | 10156992 | A1 * | 6/2002 | B66B 23/12 |
| EP | 0 169 349 | A1 | 1/1986 | |
| EP | 0169349 | A1 | 1/1986 | |
| GB | 1373795 | A * | 11/1974 | B66B 23/12 |
| WO | WO 03/051754 | | 6/2003 | |
| WO | WO 2005/073112 | | 8/2005 | |
| WO | WO 2005/073112 | A2 | 8/2005 | |
| WO | WO 2011/009521 | | 1/2011 | |

* cited by examiner

FASTENING DEVICE FOR FASTENING A STEP OR A PALLET TO A TRACTION MECHANISM

The invention relates to a fastening device for connecting a step of an escalator or a pallet of a moving walkway to a traction means.

BACKGROUND OF THE INVENTION

Passenger transport devices such as escalators and moving walkways are generally known and are efficient devices for the transportation of passengers. Escalators are typically used for transporting passengers in vertical direction, such as from one storey of a building to another storey, while moving walkways are normally used for the transportation of passengers in horizontal direction or at a slight incline of up to 12° from one point to another point. The length and width of the passenger transport device are selected in dependence of the expected passenger traffic for the respective application.

Escalator steps and pallets are designed as one-piece or multi-piece components, wherein the pieces, as a rule, are manufactured by way of casting, extruding, forging processes and the like. A number of steps are usually connected by means of two traction mechanisms to form a step band of an escalator. Similarly a number of pallets are joined to form a pallet band in the same way. A moving walkway or an escalator, as a rule, comprises a support structure or framework with two redirection areas, between which the pallet band or step band is revolvingly guided.

The connection between the traction means and the step or the pallet must be secure and long-lasting, since if the connection comes undone while the passenger transport device is in operation, this can have catastrophic consequences for the users.

The WO 03/051754 A2 discloses a pallet band, the pallets of which are fastened by screws and carrier elements to the traction means. The disadvantage of this type of connection consists in that a very large number of screws per pallet have to be used in order to achieve a sufficiently secure connection. The large number of screws, from a manufacturing point of view, is not only cumbersome and expensive, but also has a large impact on assembly time. But since there is a need for replacing steps and pallets or the traction means due to damage or wear or after a predefined time period, this assembly time occurs not only during the manufacture of an escalator or a moving walkway, but also repeatedly during maintenance of these passenger transport systems.

Furthermore the screws are arranged in a vertical direction and therefore have an almost parallel alignment with the pressure load direction of the pallet or step. The amplitudes of vibrations occurring in operation however, have mainly the same alignment, as a result of which the tightened screws may become loose. Settling effects also in the area of the screw connections may lead to a loss in screw pre-tensioning force and thus to a loosening of the screw connection. For this reason additional screw locks are often used. This means however additional expenditure with regard to material, logistics and assembly, and it also carries the risk of omitting to fit the locks, of imperfections in the screw lock itself or of an erroneous assembly result.

BRIEF DESCRIPTION OF THE INVENTION

It is therefore the requirement of the invention to provide a fastening device for connecting a step or palette to a traction means, which can be manufactured in a simple manner and at low cost, which can be quickly and simply assembled and which, despite its simple construction, is particularly well secured against becoming undone or loosening.

This requirement is met by a fastening device for connecting a step of an escalator or a pallet of a moving walkway to a traction means, wherein the fastening device comprises a shoulder, at least one wedge type connector and at least one projection. In the mounted state the at least one projection protrudes through an opening of the shoulder. Further the at least one wedge type connector is arranged at least partially between the shoulder and the projection. Due to the wedge type connector the step or pallet is pre-tensioned against the traction means and fixed on the same. The traction means may for example be a link chain, a belt or cable or such like.

The element called a wedge type connector is used to connect two components, wherein one component has a projection and the other component has the shoulder formed on it. The wedge type connector can be assembled by driving it between the projection or between a contour of the projection and the shoulder, thereby firmly connecting the two components with each other. The wedge type connector comprises at least one area which is wedge-shaped, through which, for a given drive-in force in dependence of the wedge angle of the wedge-shaped area, a pre-tensioning force can be generated. A loss of pre-tensioning force is not to be expected because the wedge angle of the wedge type connector can be kept to such a small size that due to the friction forces self-locking exists despite knocks and vibrations occurring in operation. By pre-tensioning the step or pallet against the traction means, this is permanently and securely fastened to the traction means. Furthermore the wedge type connector can be arranged orthogonally to the main direction of the above-mentioned amplitudes.

A particular advantage of the fastening device moreover consists in that a faulty assembly is instantly recognisable because if the wedge type connector is not fitted or is fitted wrongly, the steps or pallets drop off the traction means even before the passenger transport device is taken into operation. If the wedge type connector is only inserted, but not driven in, the steps or pallets rattle and the wedge type connector is visibly protruding. It is, of course, possible to monitor a correct seating of the wedge type connector by means of a monitoring sensor arranged in the escalator or moving walkway in that e.g. the position of one of its ends is optically or mechanically scanned. The number of monitoring sensors depends on the number of rows of fastening devices and thus on the number of traction means of a step band or pallet band.

Preferably the traction means is a link chain with chain plates. The chain plates are connected with each other by means of chain pins serving as link points. A receiving point for a part of an associated pallet or step may be formed on each of the chain plates between two link points. This receiving point, after assembly, is in contact with the associated step or pallet.

In one embodiment of the invention the at least one projection could be formed on the step or pallet and the shoulder could be formed in the area of the receiving point of the chain plate. The step or pallet is limited in its width by two parallel faces extending in the intended movement of direction of the step or pallet. If the step band or pallet band to be manufactured comprises two traction means, at least one projection may be arranged on each of the two faces. In this way the steps or pallets can be arranged between the two traction means and can connect these with each other transversely to the intended movement of direction.

In a further embodiment the shoulder could alternatively be formed on the step or pallet and the at least one projection could be formed in the area of the receiving point of the chain plate. With this embodiment also, the step or pallet may be limited in its width by two parallel faces extending in the intended movement of direction of the step or pallet. Further, at least one shoulder can be arranged on each of the two faces.

For guiding the step band or pallet band between the two redirection areas, guide rails are normally arranged in the support structure. These guide rails have gliding bodies gliding on them or rollers rolling on them, which are arranged on the traction means or on the steps or the pallets. If link chains are used, the rollers are preferably arranged in the area of the link points on the traction means. The advantage of this is that the connecting bolts of the link chain simultaneously serve as roller axes.

The wedge type connector may comprise at least one elastic wedge-type tab forming the wedge-shaped area, wherein the wedge-type tab when mounted is arranged between the projection and the shoulder. The elastic wedge-type tab has the advantage that manufacturing tolerances between the projection and the shoulder do not lead to different end positions of the wedge type connector in the mounted state. For if the wedge type connector would comprise a rigid wedge-type tab, this could be driven between the projection and the shoulder only to the extent permitted by the existing distance between a placement contour/lobe of the projection and a placement surface of the shoulder. Due to the elastic wedge-type tab the wedge type connector can adapt to the respectively existing distance and can fix the step or pallet on the traction means pre-tensioned on the same.

For easy handling during assembly the wedge type connector may be formed in an L-shape and comprise a first shank and a second shank. The at least one wedge type tab is formed on a first shank. The second shank serves as a placement point for tools in order to drive the first shank/the wedge-type tab (elastic or rigid) between the projection and the shoulder. The second shank may further serve as a placement point for removing the wedge type connector when it is necessary to remove the step or pallet from the traction means.

In addition the first shank may comprise at least one receiving opening for receiving a lobe of the projection. The at least one wedge-type tab is preferably formed on the rim of this receiving opening. When only one pallet is to be connected to the traction means, a wedge type connector is initially arranged on the shoulder such that the opening of the shoulder and the receiving opening are aligned with each other. The pallet is then placed on the traction means, so that the projection protrudes through the opening of the shoulder and through the receiving opening. Subsequently the wedge type connector is linearly moved relative to the projection and to the shoulder, so that the wedge-type tab gets between the lobe and shoulder. Preferably the second shank limits the movement path in that it abuts against a contour of the pallet or the shoulder. In order to additionally secure the wedge-type connector, a placement point for a fastening means may be formed on the second shank, which firmly connects the second shank to the abutting contour. The same procedure of course also applies to the assembly of a step band, where instead of the pallets, steps are arranged on the traction means. The fastening means may be a screw, rivet, clamping claw, spring clip or the like.

The projection can be any sort of shape. The only requirement as regards the projection is, that it comprises at least one lobe so that the wedge type connector has a placement contour in order to get a hold on the projection. Manufacture is especially simple and cost-effective if the lobe of the projection is created by means of a groove formed on the projection. Instead of the groove the lobe may also be produced by means of milling or puncturing or recessing or undercutting or back-turning.

Depending on the application, the step or palette comprises a stepping surface, onto which the users step when the step band or pallet band is in operation. Stepping onto the stepping surface and possibly dirt on the guide rails mentioned earlier above can cause vibrations and knocks, the amplitudes of which occur in the main in orthogonal direction to the stepping surface. Therefore the at least one wedge type connector is preferably pushed in between the associated shoulder and the associated projection in an assembly direction parallel to the stepping surface.

The invention can, of course, be used not only in new escalators or moving walkways. For example, an existing escalator or an existing moving walkway can be modernised in that the existing pallet band is replaced by a pallet band according to the invention or the existing step band is replaced by a step band according to the invention.

BRIEF DESCRIPTION OF THE DRAWINGS

The fastening device for connecting a step or pallet to the traction means will now be described in detail by way of examples and with reference to the drawings, in which FIG. 1 schematically shows a moving walkway with a support structure and two redirecting areas, wherein guide rails are arranged in the support structure and a revolving pallet band is arranged between the redirection areas.

DETAILED DESCRIPTION OF THE INVENTION

Figure 1:
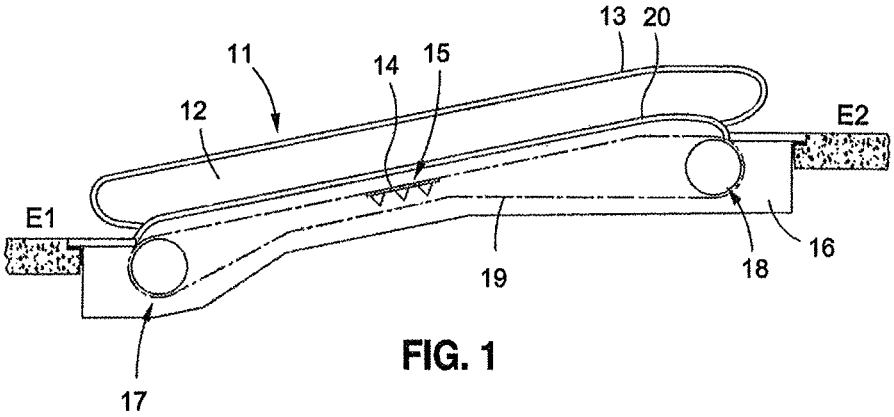

FIG. 1 schematically shows, in a side view, a moving walkway 11, which connects a first floor E1 with a second floor E2. The moving walkway 11 could, of course, also connect two places on one and the same level as e.g. is often the case in long corridors of airports. The moving walkway 11 comprises a support structure 16 or framework 16 with two redirection areas 17, 18, between which a pallet band 15 is revolvingly guided. The pallet band comprises traction means 19 which have pallets 14 arranged on them. A hand rail 13 is arranged on a balustrade 12. At its lower end the balustrade 12 is connected to the support structure 16 by means of a balustrade skirting 20.

Since an escalator comprises essentially components similar to the above-described moving walkway 11, no further figure showing an escalator and a respective description has been added.

Figure 2:
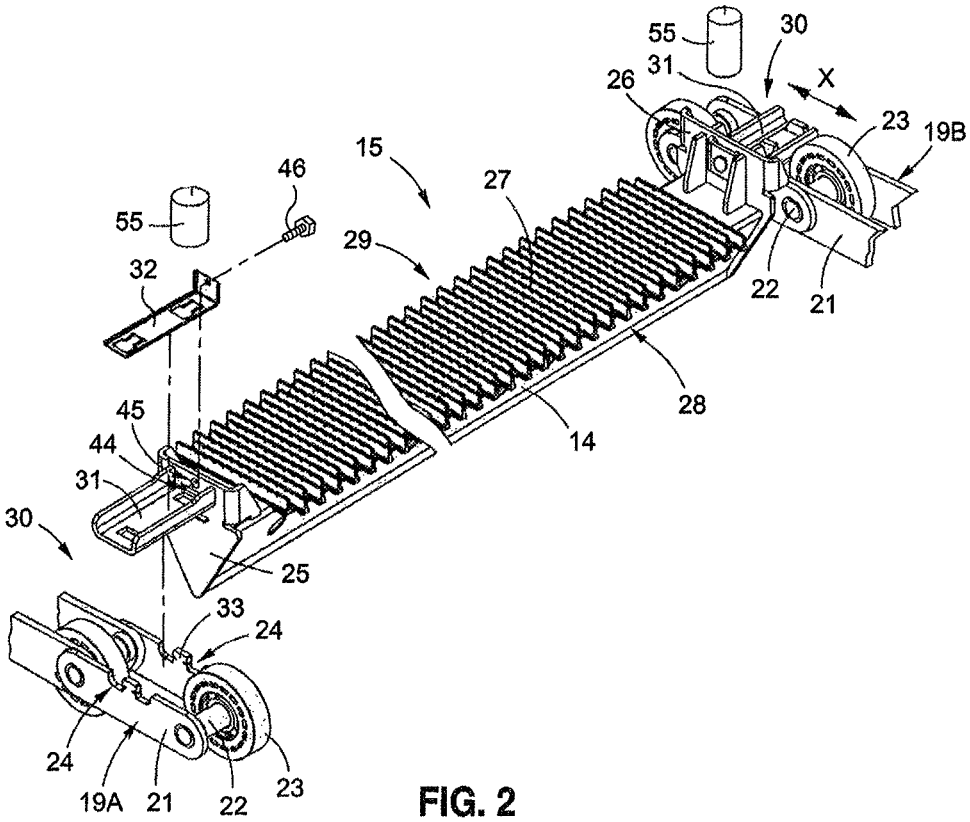
FIG. 2 shows an explosive view of a pallet band section, depicting two traction means and a pallet arranged between the traction means.

FIG. 2 shows an explosive view of a section of the pallet band 15 schematically depicted in FIG. 1. The pallet band comprises two traction means 19A, 19B. The traction means 19A, 19B shown are sections of two link chains 19A, 19B, the chain plates 21 of which are connected with each other via chain pins 22 to form two endless link chains 19A, 19B. The chain pins 22 serve not only as link points but also as axes 22 for rollers 23. These rollers 23 run on guide rails not shown, which are arranged in the support structure 16 of the moving walkway 11 of FIG. 1. The guide rails guide the rollers 23 and thus the traction means 19A, 19B, supporting them against gravity thus ensuring that the pallet band 15 does not sag between the two redirection areas 17, 18.

A plurality of pallets are arranged between the two traction means 19A, 19B, wherein for reasons of clarity only one pallet 14 is depicted in FIG. 2. At each of the chain plates 21, between respectively two link points 22, a receiving point 24 for a part of an associated pallet 14 is formed. This receiving point 24, when mounted, is in contact with the associated pallet 14.

The pallet 14 is limited in its width by two parallel faces 25, 26 extending in the intended direction of movement X of the pallet. A rectangular stepping surface 27 extends between the two faces 25, 26. The topside of the stepping surface 27 has a stepping pattern in form of a number of parallel ribs or webs extending from the front edge 28 to the rear edge 29 of the stepping surface 27. The ribs also extend in the intended direction of movement X of pallet 14. Furthermore the ribs are dimensioned for engaging into comb structures not shown, which are arranged in the redirection areas 17, 18 of the moving walkway 11.

Each of the two faces 25, 26 has a shoulder 31 arranged on it. This permits the pallets 14 to be arranged between the two traction means 19A, 19B and to connect these with each other transversely to the intended direction of movement X. The shoulder 31 belongs to a fastening device 30 for connecting or fastening a palette 14 or step to traction means 19A, 19B.

The fastening device 30/the correct seating of the wedge type connector 32 can be monitored by means of a monitoring sensor 55 arranged in the escalator or the moving walkway. The monitoring sensor 55 is fixed in position on a support structure not shown, so that for a complete cycle of the pallet band 15 each fastening device 30 will have moved past the monitoring sensor 55. For monitoring purposes the position of an end of the wedge type connector 32 is preferably scanned optically or mechanically. The minimum number of monitoring sensors 55 per escalator or moving walkway depends on the number of rows of fastening devices 30 and thus on the number of traction means 19A, 19B of a step band or pallet band.

Figure 3:
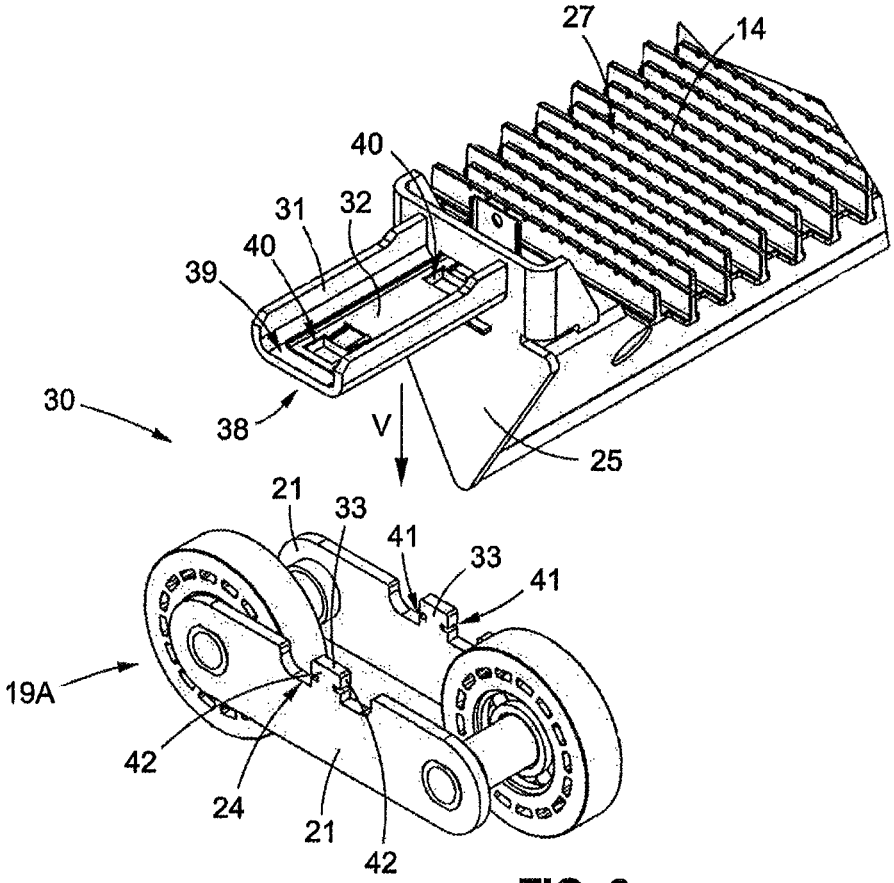
FIG. 3, in a three-dimensional view, shows the placing of the pallet of FIG. 2 onto the traction means in a first assembly step.
Figure 4:
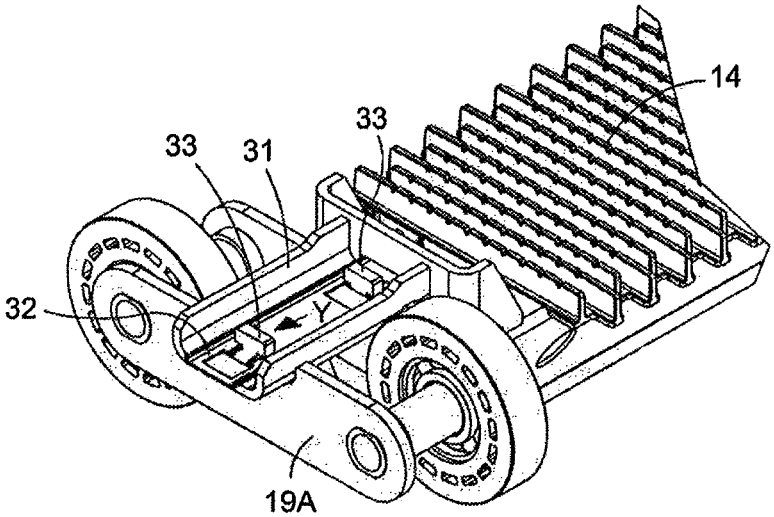
FIG. 4, in a three-dimensional view, shows the fixing of the pallet of FIG. 3 to the traction means by means of a wedge type connector in a second assembly step.
Figure 5:
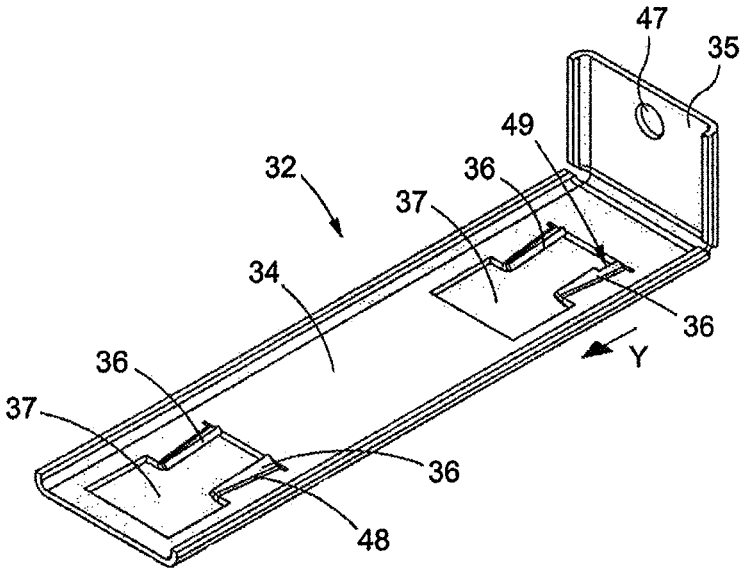
FIG. 5, in an enlarged three-dimensional view, shows the wedge type connector of FIGS. 2 to 6.

Assembly of the fastening device 30 and its elements, i.e. the shoulder 31, wedge type connector 32 and projection 33, are shown in detail in FIGS. 3 to 5, wherefore these elements are hereunder described together with the same reference symbols being used in the figures.

FIG. 3, in a three-dimensional view, shows the fastening device 30 of FIG. 2 in a pre-mounted state, and it also shows the placing of the pallet 14 onto the traction means 19A as a first assembly step. As a second assembly step FIG. 4 shows, in a three-dimensional view, the fixing of the pallet 14 shown in FIG. 3, on the traction means 19A by means of the wedge type connector 32.

FIG. 5 shows a three-dimensional enlarged view of the wedge type connector 32. In order to make handling of the wedge type connector easier during assembly, the wedge type connector 32 is formed in an L-shape and comprises a first shank 34 and a second shank 35. The second shank 35 serves as a placement point for tools, in order to move the first shank 34. The second shank 35 can further serve as a placement point in order to remove the wedge type connector 32, when the pallet 14 needs to be disassembled from the traction means 19A. The first shank 34 has two receiving openings 37 arranged on it, wherein in the mounted state each lobe of the projection 33 protrudes through each of the receiving opening 37, as shown in FIG. 4. On the rim of these receiving openings 37 two elastic wedge-type tabs 36 are formed which are arranged parallel to an intended moving direction Y. In the present embodiment each elastic wedge-type tab 36 is created by bending a material area of the first shank 34 upwards along a bending line 48 extending obliquely to the moving direction Y.

The wedge type connector 32 may be manufactured from suitable metals or suitable plastics. Preferably the wedge type connector 32 is manufactured from spring steel sheet. Metal-plastic combinations are, of course, also possible, for example, the shanks 34, 35 may be made from steel and the wedge-type tabs may be made from a plastic.

As shown in FIGS. 3 and 4, the shoulder 31 is arranged on the face 25 of the pallet 14 and essentially extends in a plane parallel to the stepping surface 27. The shoulder 31 comprises a contact point 38 facing the traction means 19A and a placement surface 39 facing away from the traction means 19A. The contact point 38, in the mounted state, rests on the receiving point 24 of the traction means 19A. Furthermore two openings 40 are formed on the shoulder 31. These are adapted to match the distance between the two chain plates 21 of the traction means 19A, which are arranged in parallel to each other, and thus adapted to match the distance between the projections 33 formed on each chain plate 21.

The projections 33 are formed centrally in the receiving points 24 and comprise two lateral grooves 41 each. Due to these grooves 41 the projection 33 comprises two lobes 42, which serve as a placing contour for the wedge-type tabs 36 of the wedge type connector 32.

When the pallet 14 is then to be connected to the traction means 19A, a wedge type connector 32, as shown in FIG. 3, is initially arranged on the placement surface 39 of the shoulder 31 such that the openings 40 of the shoulder 31 and the receiving openings 37 are aligned with each other such that the cross-section of the passage is at its maximum. In the present exemplary embodiment the wedge type connector 37 is arranged and guided in an elongated hole 44 (see FIG. 2) of the face 25. Then the pallet 14 is placed in vertical direction V onto the traction means 19A so that the projections 33 protrude through the associated openings 40 of the shoulder 31 and through the receiving openings 37.

Subsequently, as shown in FIG. 4, the wedge type connector 32 is linearly moved on the placement surface 39 in moving direction Y or assembly direction Y as well as relative to the projections 33 and to the shoulder 31, so that the wedge-type tabs 36 get in between the lobes 42 and the shoulder 31. With this arrangement the second shank 35 limits the movement path in that it abuts against the face 25 of the pallet 14.

As can be seen in FIG. 4, the elastic wedge-type tabs 36, in the mounted state, are arranged between the projection 33 and the shoulder 31. The elastic wedge-type tab 36 has the advantage that manufacturing tolerances between the lower edge of the lobe 42 and the placement surface 39 do not lead to different end positions of the wedge type connector 32, when in the mounted state. For if the wedge type connector 32 had a rigid wedge-type tab, this could only be driven between the projection 33 and the shoulder 31 to an extent permitted by the existing distance between the lobe 42 of the projection 33 and the placement surface 39 of the shoulder 31 as well as by the ductility of the materials. Due to the elastic wedge-type tab 36 the wedge type connector 32 can adapt to the respectively existing distance and can fix the pallet 14 against the traction means 19A in a pre-tensioned state.

In order to additionally secure the wedge type connector 32, a placement point 47 for a fastening means 46 can be formed on the second shank 35 as shown in FIG. 5. In the present embodiment of FIG. 2 the fastening means 46 is a screw and the placement point 47 is a through-bore. Further, a threaded hole 45 is arranged in the face. In the mounted state the fastening means 46 protrudes through the placement point 47 and the face 25, so that it firmly connects the second shank 35 to the face 25.

As a further securing means a catch 49 may be formed on at least one of the elastic wedge-type tabs 36. This allows the elastic wedge-type tab 36 to partially spring back, after the wedge type connector 32 has been pushed in. The catch 49 is then form-locked with the projection 33 and as a result holds the wedge type connector 32 permanently in position. It goes without saying that catches 49 may be formed on all elastic wedge-type tabs 36, wherein when the elastic wedge-type tabs 36 are designed, care must be taken that they remain sufficiently strongly pre-tensioned when assembled.

As already mentioned further above, the second shank may also serve as a disassembly aid. Instead of the placement point 47 a threaded bore may be provided. Besides the face 25 must not have a threaded hole. When the wedge type connector 32 is to be moved contrary to the moving direction Y or assembly direction Y in order to undo the fastening device 30, a screw may be screwed into the threaded hole, which then abuts against the face 25 and moves the wedge type connector 32 during further turning.

Figure 6:
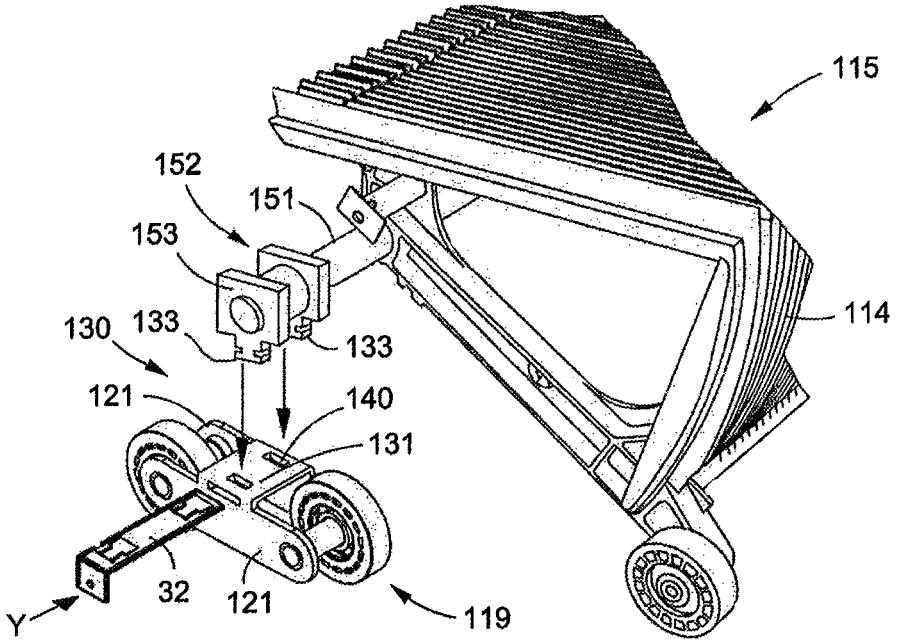
FIG. 6 shows an explosive view of half of a step band section, wherein the traction means has a shoulder and two projections associated with this shoulder arranged laterally on the step.

The same procedure applies; of course, to the assembly of a step band 115, where by means of a fastening device 130, a plurality of steps 114 are arranged on a traction means 119. FIG. 6 shows an explosive view of half of a section of the step band 115. The step 114 itself is no different from conventional steps, wherefore a detailed description of the same has been omitted.

In deviation from known embodiments the step 114 has a step axis 151 arranged on it, which on each of its ends 152 (only one end 152 is shown) comprises a pivot bearing 153 with two projections 133. The pivot bearing 153 is pivotably mounted on the step axis 151, so that the step 114, when revolving, can align with the guide rails not shown. The traction means 119 comprises chain links 121, wherein two chain links 121, respectively arranged in parallel with each other are connected with each other by a shoulder 131. This shoulder 131 also comprises openings 140 for inserting the projections 133. The shoulder 131 and the projections 133 are connected to the wedge type connector already described. Although with this embodiment the shoulder 131 is formed on the traction means 119 and the projections 133 are formed on the steps 114, the resulting fastening device 130 for connecting a step 114 to a traction means 119 corresponds exactly to the fastening device 30 shown in FIGS. 2 to 4 for connecting a pallet 14 to a traction means 19A, 19B.

Although the invention has been described by way of specific exemplary embodiments, it is obvious that numerous further variants can be produced in the knowledge of the present invention, for example, in that the projections are arranged on the pallets and the shoulders are arranged on the traction means. Further instead of link chains, wire ropes, aramid ropes or belts may be used, wherein additional parts such as clamps or springs need to be arranged on these, which then comprise the projections or shoulders. It goes without saying that a first projection and a first shoulder may be formed on the step or pallet, and a projection matching the first shoulder and a second shoulder matching the first projection may be arranged on the traction means.

Further two traction means are required which may be optionally arranged laterally of the pallets or the steps. Or a step band or pallet band could comprise only one traction means, which is preferably arranged centrally to the steps or pallets.

The invention claimed is:

1. A fastening device for connecting a step of an escalator or a pallet of a moving walkway with a traction means, comprising a shoulder element on one of the traction means and the step or pallet, respectively, at least one wedge type connector, and a projection located on the other of the traction means and step or pallet, the shoulder element having an opening through which the projection protrudes in a mounted state of the fastening sdevice, the at least one wedge type connector being arranged at least partially between the shoulder and the projection whereby the step or pallet is fixed and pretensioned by the wedge type connector against the traction means.

2. The fastening device according to claim 1, wherein the wedge type connector comprises a wedge type tab located and positioned to be arranged between the projection and the shoulder in the mounted state.

3. The fastening device according to claim 1, wherein the step or pallet comprises a stepping surface and the wedge type connector is constructed and adapted to be pushed in between the associated shoulder and projection in an assembly direction parallel to the stepping surface.

4. The fastening device according to claim 1, wherein the wedge type connector is formed in an L-shape and comprises a first shank and a second shank.

5. The fastening device according to claim 4, wherein the first shank comprises at least one receiving point for receiving a lobe of the projection and the second shank has a formed placement point for a fastening means.

6. The fastening device according to claim 5, wherein the lobe of the projection terminates at a groove formed on the projection.

7. The fastening device according to claim 1, wherein the traction means is a link chain with chain plates, which chain plates are connected with each other by means of link points, and a receiving point is formed at each of the chain plates between two respective link points, the wedge connector being arranged to fix the receiving point in contact with the associated step or pallet in the mounted state.

8. The fastening device according to claim 7, wherein the projection is formed on the step or pallet and the shoulder is formed in an area of the receiving point of the chain plate.

9. The fastening device according to claim 8, wherein the step or pallet is limited in its width by two parallel faces extending in the intended movement direction of the step or pallet and the projection is arranged on a face.

10. The fastening device according to claim 7, wherein the shoulder is formed on the step or pallet and the projection is formed in the area of the receiving point of the chain plate.

11. The fastening device according to claim 10, wherein the step or pallet is limited in its width by two parallel faces extending in the intended movement direction of the step or pallet, a shoulder is arranged on a face.

12. An escalator step band with two traction means and a plurality of steps wherein the steps are fastened to the traction means by means of a plurality of the fastening device according to claim 1.

13. A moving walkway pallet band with two traction means and a plurality of pallets wherein the pallets are fastened to the traction means by means of a plurality of the fastening device according to claim 1.

14. An escalator, comprising a step band with two traction means and a plurality of steps, wherein the steps are fastened to the traction means by means of a plurality of the fastening device according to claim 1.

15. A moving walkway comprising a pallet band with two traction means and a plurality of pallet, wherein the pallets are fastened to the traction means by a plurality of the fastenings device according to claim 1.

16. A method to modernize an escalator comprising the step of replacing an existing step band by a step band according to claim 12.

17. A method to modernize a moving walkway comprising the step of replacing an existing pallet band by a pallet band according to claim 13.

* * * * *